United States Patent [19]

Deane et al.

[11] Patent Number: 4,989,680

[45] Date of Patent: Feb. 5, 1991

[54] DRILL BIT HAVING IMPROVED HYDRAULIC ACTION FOR DIRECTING DRILLING FLUID

[75] Inventors: John D. Deane; Craig R. Ivie, both of Houston, Tex.

[73] Assignee: Camco International Inc., Houston, Tex.

[21] Appl. No.: 381,040

[22] Filed: Jul. 17, 1989

Related U.S. Application Data

[63] Continuation-in-part of Ser. No. 162,289, Jan. 29, 1988, Pat. No. 4,848,476, which is a continuation of Ser. No. 908,080, Sep. 15, 1986, Pat. No. 4,741,406.

[51] Int. Cl.[5] ..... E21B 10/18

[52] U.S. Cl. ..... 175/340

[58] Field of Search ..... 175/340, 339

[56] References Cited

U.S. PATENT DOCUMENTS

| | | | |
|---|---|---|---|
| 1,922,436 | 8/1933 | Herrington . | |
| 1,990,007 | 2/1935 | Sperry | 175/340 |
| 2,098,758 | 11/1937 | Reed . | |
| 2,192,693 | 3/1940 | Payne | 175/340 |
| 2,244,617 | 6/1941 | Hannum | 175/340 |
| 2,815,936 | 12/1957 | Peter et al. . | |
| 3,014,544 | 12/1961 | Steen | 175/340 |
| 3,137,354 | 6/1964 | Crawford et al. | 175/340 |
| 3,823,789 | 7/1974 | Garner | 175/340 |
| 4,106,577 | 8/1978 | Summers | 175/340 |
| 4,222,447 | 9/1980 | Cholet | 175/340 |
| 4,239,087 | 12/1980 | Castel et al. | 175/340 |
| 4,513,829 | 4/1985 | Coates | 175/339 |
| 4,516,642 | 5/1985 | Childers et al. | 175/340 |
| 4,546,837 | 10/1985 | Childers et al. | 175/340 |
| 4,558,754 | 12/1985 | Childers et al. | 175/340 |
| 4,582,149 | 4/1986 | Slaughter, Jr. | 175/340 |
| 4,741,406 | 5/1988 | Deane et al. | 175/340 |
| 4,848,476 | 7/1989 | Deane et al. | 175/340 |

FOREIGN PATENT DOCUMENTS

| | | | |
|---|---|---|---|
| 36772 | 9/1981 | European Pat. Off. | 175/340 |
| 38125 | 10/1981 | European Pat. Off. . | |
| 597804 | 3/1978 | U.S.S.R. | 175/339 |
| 1104310 | 2/1968 | United Kingdom . | |

*Primary Examiner*—Hoang C. Dang

*Attorney, Agent, or Firm*—Dodge Bush & Moseley

[57] ABSTRACT

A rotary drill bit (10) has three roller cutters (20A, 20B and 29C) mounted thereon for rotation with a plurality of cutting elements (26) arranged in concentric annular rows (28A, 28B, 28C, 28D) thereon. A high velocity drilling fluid is discharged from nozzle orifices (40, 42, 52) and the orifices are sized and positioned so that more hydraulic energy is directed against the cutting elements (26) in the gage row (28D) than against the cutting elements (26) in the remaining rows (28A, 28B, 28C). The drilling fluid impinges the cutting elements (26) on the leading side of the roller cutters (20A, 20B, 20C) immediately prior to engagement of the cutting elements (26) with the bore hole bottom (30) and then sequentially strikes the bore hole bottom formation at or closely adjacent the juncture (35) of the horizontal bottom portion (32) with the vertical side portion (34).

14 Claims, 3 Drawing Sheets

FIG. 4
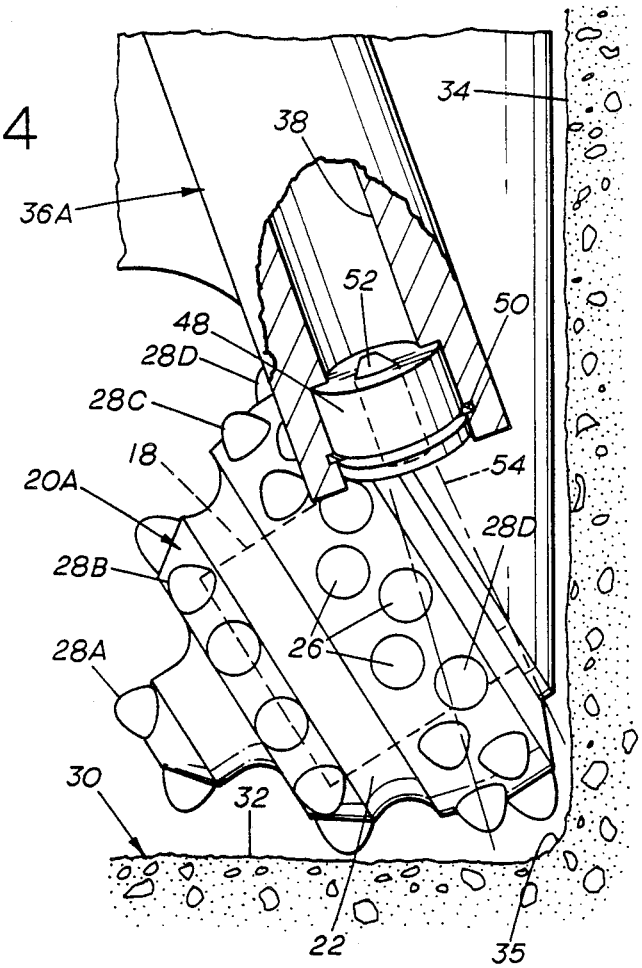
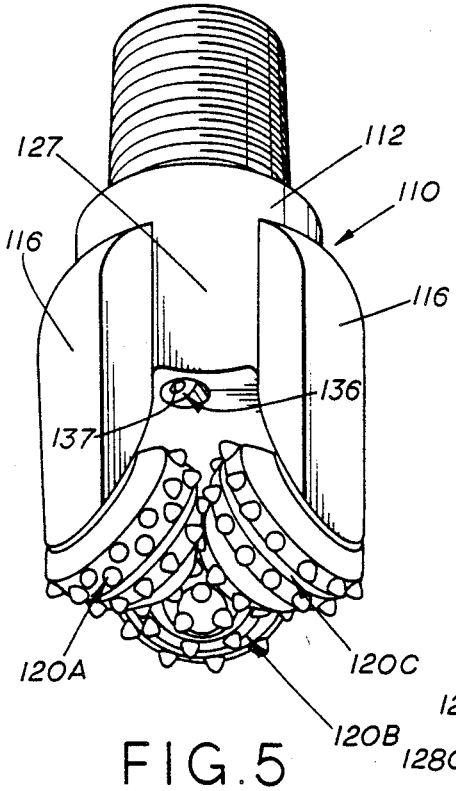
FIG. 5
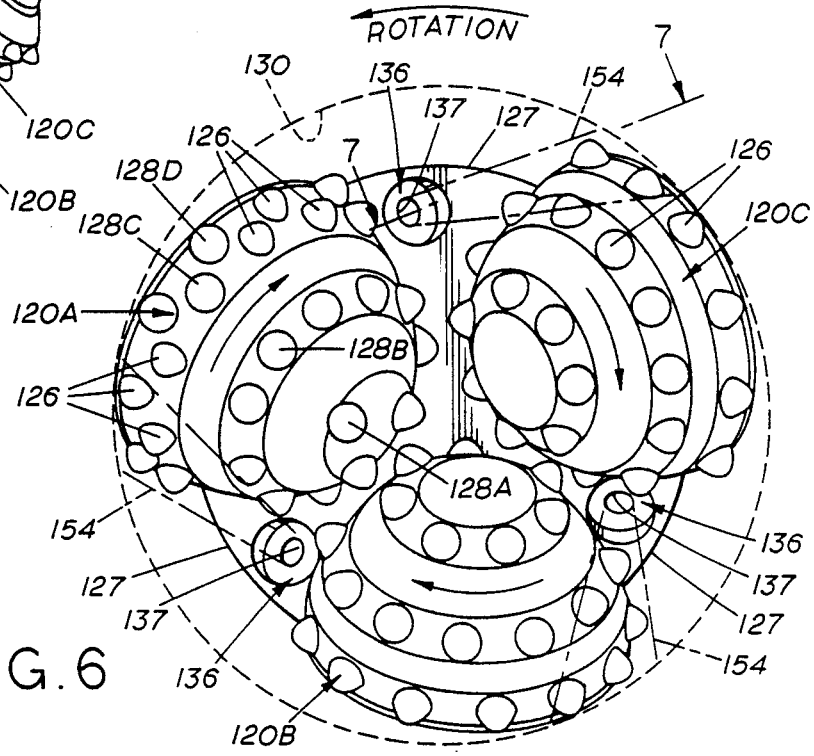
FIG. 6

DRILL BIT HAVING IMPROVED HYDRAULIC ACTION FOR DIRECTING DRILLING FLUID

CROSS-REFERENCE TO OTHER APPLICATIONS

This is a continuation-in-part of pending prior U.S. patent application serial No. 162,289 filed Jan. 29, 1988 for Drill Bit Having Offset Roller Cutter and Improved Nozzles, now U.S. Pat. No. 4,848,476 issued July 18, 1989; which is a continuation of prior application Ser. No. 908,080 filed Sept. 15, 1986, now U.S. Pat. No. 4,741,406 issued May 3, 1988.

BACKGROUND OF THE INVENTION

This invention relates to rotary drill bits for drilling oil wells and the like, and more particularly to an improved hydraulic action of drilling fluid against the roller cutters of the drill bit and the formation being drilled.

While conventional drill bits have been satisfactory for drilling relatively brittle formations, they do not provide satisfactory rates of penetration when drilling relatively plastically deformable formations. Many commonly encountered formations such as salts, shales, limestones, sandstones and chalks, become plastically deformable under so-called differential pressure conditions, when the hydrostatic pressure of the column of drilling fluid bearing on the bottom of the well bore exceeds the pressure of the formation surrounding the bore, as often occurs in deep hole drilling. Whereas, brittle formations tend to crack or fracture when engaged by the cutting elements of a drill bit, these plastic formations tend to deform and thus remain intact under such loads. In addition, certain of these plastic formations tend to form a relatively thick coating of drilling debris on the roller cutter which can result in so-called "bit-balling" and limited penetration of the formation by the cutting elements.

Attempts have been made to increase the rate of penetration in plastic formations by using extended nozzles for improving the cleaning action of the hydraulic system. While this nozzle arrangement may offer some measure of improved cleaning action, this action is still not satisfactory for many types of plastic formations. Moreover, in this arrangement, the nozzles extend down to points closely adjacent to the bottom of the well bore, and thus are subject to damage by irregularities, such as projections or ridges, on the bottom of the well bore, which may form from time to time during drilling operations.

One area of the formation, particularly in so-called "sticky" formations, tends to adhere abnormally to the gage row of cutting elements on the roller cutter which is the outermost row that determines the diameter or gage of the bore hole. The cutting elements of the gage row normally engages the bore hole bottom at the juncture of the horizontal bottom portion and the cylindrical side portion. Thus, the cutting elements of the gage row are normally engaging the portion of the formation defined by two separate formation surfaces generally at right angles to each other. As a result it has been found that oftentimes an increased amount of so-called sticky formations tends to adhere to the gage row of cutting elements.

SUMMARY OF THE INVENTION

The present invention is particularly directed to a rotary drill bit having three roller cutters with a plurality of concentric rows of cutting elements on each cutter, and an improved cleaning action for the gage row of cutting elements and the adjacent bore hole formation generally at the juncture of the horizontal bottom portion and cylindrical side portion of the bore hole.

It is noted that the gage row of each roller cutter is the row that most affects the rate of penetration of the rotary drill bit. The gage row normally has more cutting elements therein than the remaining rows. Also, the formation is stronger at the annular corner of the bore hole formed at the juncture of the horizontal bottom surface and the vertically extending cylindrical side surface of the bore hole formation. Thus, the gage row of cutting elements is the critical row in determining the rate of penetration.

Additionally, in a rotary drill bit having three roller cutters, a so-called "interlocking" row of cutting elements is provided immediately adjacent the gage row normally on two of the three roller cutters. The interlocking row includes cutting elements which are staggered and fit between the cutting elements of the gage row in radially offset relation. The interlocking row of cutting elements along with the gage row are thus provided for cutting the formation at its strongest area. It is desirable that maximum cleaning action by the pressurized drilling fluid be provided particularly for the cutting elements in such gage and interlocking rows, and the present invention is directed to such a cleaning action in combination with a subsequent scouring action of the drilling fluid against the adjacent formation in the area of the corner of the bore hole.

A high velocity liquid stream of drilling fluid is provided for each of the roller cutters and the liquid stream for each roller cutter is directed against at least the cutting elements in the gage row on the leading side of the cutter with the cutting elements entering the stream for being cleaned thereby and then exiting the stream prior to engaging the formation at the bottom of the bore hole so that the cutting elements and formation impinged by the stream are subjected to separate and sequential cleaning actions by the stream of drilling fluid immediately prior to their engagement.

As indicated, the cutting elements in the gage row engage the bore hole bottom at or closely adjacent the juncture of the horizontal bottom portion and cylindrical side portion of the bore hole bottom. Thus, two separate bore hole surfaces generally at right angles to each other are engaged by the cutting elements in the gage row and oftentimes, particularly for soft sticky formations, more of such formation materials tends to stick or collect between the cutting elements on the gage row than between the cutting elements on the other rows. It is desirable, therefore, in order to have a balanced washing action by the drilling fluid, that more hydraulic energy be directed against the cutting elements in the gage row than the cutting elements in the remaining rows. For that purpose, the nozzle orifice for the high velocity drilling fluid directed against the cutting elements of the gage row is constructed and arranged to provide increased hydraulic energy first against the cutting elements in the gage row and then sequentially against the bore hole bottom formation at or closely adjacent the juncture of the horizontal bottom portion with the vertical side portion.

It is an object of the present invention to provide a rotary drill bit having conically shaped roller cutters thereon with an improved hydraulic action of drilling fluid against the cutting elements on the roller cutter and sequentially against the formation being drilled immediately prior to the engagement of the cutting elements with the bore hole bottom.

A further object of the present invention is to provide such a rotary drill bit in which an improved hydraulic action of the drilling fluid is directed against the cutting elements in the gage row to provide more hydraulic energy against the cutting elements in the gage row than the cutting elements in the remaining rows.

An additional object of the present invention is to provide such a rotary drill bit in which the orifice for directing drilling fluid against the cutting elements of each roller cutter is constructed and arranged to provide more hydraulic energy against the cutting elements of the gage row than the remaining cutting elements.

Other objects and features will be in part apparent and in part pointed out hereinafter.

BRIEF DESCRIPTION OF THE DRAWINGS

FIG. 4 is a schematic view of a portion of the rotary drill bit shown in FIG. 3 taken generally along line 4—4 of FIG. 3 and illustrating the stream of drilling fluid directed against the gage row and interlocking row at the juncture of the horizontal bottom portion and vertical side portion of the bore hole;

FIG. 5 is a perspective of a modified rotary drill bit having a more central discharge nozzle for each roller cutter and arranged to provide increased hydraulic energy against the cutting elements of the gage row of the roller cutters and the adjacent bore hole formation;

FIG. 6 is a bottom plan of the modified rotary drill bit shown in FIG. 5;

DESCRIPTION OF THE PREFERRED EMBODIMENT

Figure 1:
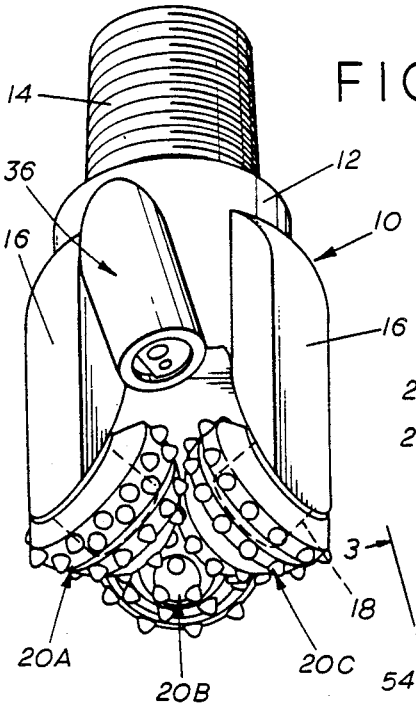
FIG. 1 is a perspective of one embodiment of the rotary drill bit of this invention including three cones or roller cutters of a generally conical shape thereon and discharge along the outer periphery of the bit body.
Figure 2:
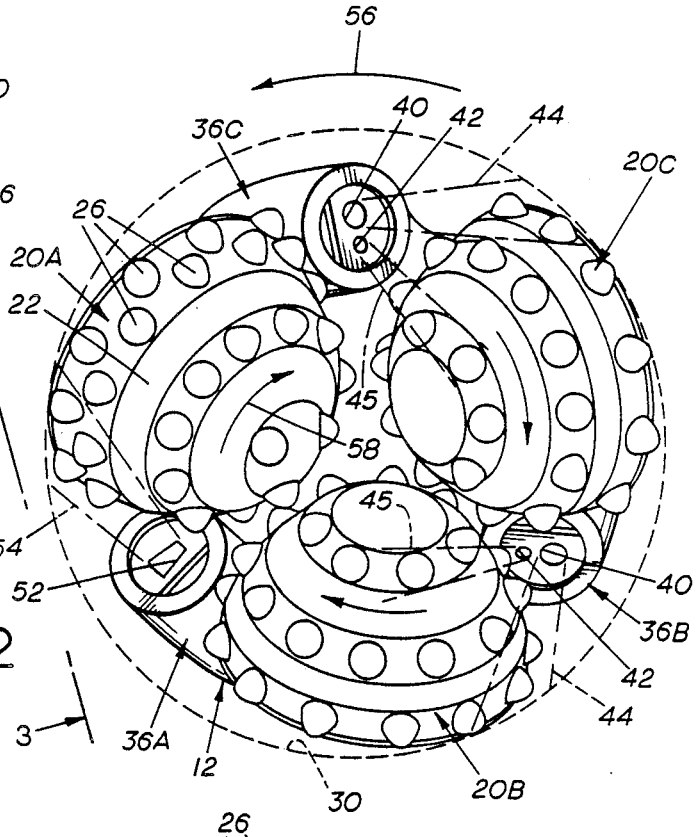
FIG. 2 is an axial plan view of the rotary drill bit of FIG. 1 showing the three roller cutters with annular rows of elements thereon.

Referring now to the drawings for a better understanding of this invention, and more particularly to the embodiment shown in FIGS. 1–4, a rotary drill bit 10 is shown in FIG. 1 comprising a central main body or shank 12 with an upwardly extended threaded pin 14. Threaded pin 14 comprises a tapered pin connection adapted for threadedly engaging the female end of a drill string (not shown) and to receive drilling fluid which is connected to a source of drilling fluid at a surface location.

Main body or shank 12 is formed from three integral connected lugs to define upper body portion below pin 14 and three downwardly extending legs 16. Each leg 16 has an inwardly and downwardly extending, generally cylindrical bearing journal 18 at its lower end. Roller cutters 20A, 20B, and 20C are mounted on journal 18 for rotation and each roller cutter is formed of a generally conical shape. Each roller cutter 20A, 20B and 20C comprises a generally conical body 22 having a recess therein receiving an associated bearing journal 18. A plurality of generally elongate cutting elements 26 have cylindrical bodies mounted in sockets within body 22 and outer tips extending from the outer surface of body 22. Cutting elements or inserts 26 may be made of a suitable powder metallurgy composite material having good abrasion and erosion resistant properties, such as sintered tungsten carbide in a suitable matrix. A hardness from about 85 Rockwell A to about 90 Rockwell A has been found to be satisfactory.

The cutting elements 26 are arranged on body 22 in concentric annular rows 28A, 28B, 28C, and 28D. Row 28D is the outermost row and comprises the gage row of cutting elements 26 that determines the final diameter or gage of the formation bore hole which is generally indicated at 30. Row 28C is adjacent to row 28D and comprises an interlocking row on cutter 20A. Cutting elements 26 on row 28C are staggered circumferentially with respect to cutting elements 26 on row 28D and a portion of cutting elements 26 on row 28C projects within the circular cutting path of row 28D. Thus, the cutting paths of the cutting elements 26 on rows 28C and 28D of roller cutter 20A overlap. It is noted that row 28C for cutters 20B and 20C is not an interlocking row as spaced substantially inward of row 28D and cutting elements 26 on row 28C do not project within the cutting path of row 28D. In some instances, it may be desirable to provide two cutters or possibly all of the cutters with interlocking rows of cutting elements.

The bottom of bore hole 30 includes a horizontal bottom portion 32 and an adjacent cylindrical side wall portion 34 extending vertically generally at right angles to horizontal bottom portion 32. The juncture of horizontal bottom portion 32 and cylindrical side wall portion 34 is shown at 35. The cutting elements 26 on gage row 28D engage the formation in cutting relation generally at the juncture 35 formed by horizontal bottom portion 32 and the vertical side wall portion 34.

Figure 3:
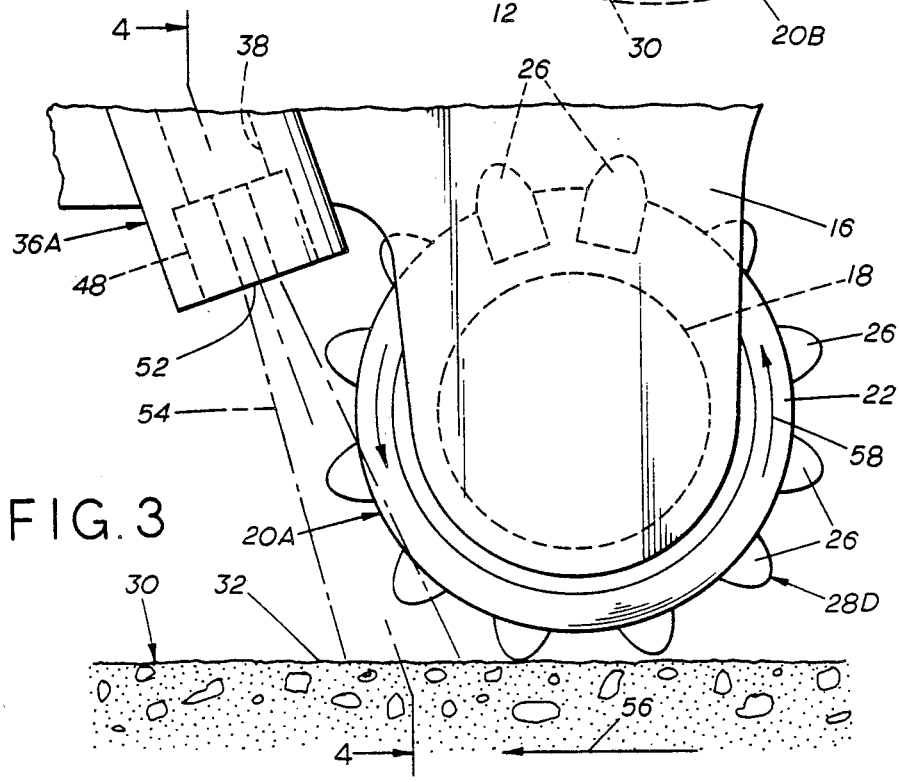
FIG. 3 is an elevation of a portion of the rotary drill bit of FIGS. 1 and 2 taken generally along line 3—3 of FIG. 2 and showing a stream of drilling fluid directed against the gage row of cutting elements of a roller cutter and the adjacent formation at the bottom of the bore hole.

To provide high velocity drilling fluid for the improved cleaning action, particularly for the gage row 28D and adjacent row 28C of cutting elements 26, a directed nozzle fluid system is provided. The fluid system includes a nozzle generally indicated at 36 positioned between each adjacent pair of legs 16 on the outer circumference of bit body 12 at a location above the rotational axis of roller cutter 20A at the juncture or connection of associated journal 18 and leg 16 as shown in FIG. 3. Each nozzle 36 has a drilling fluid passage 38 thereto from the drill string which provides high velocity drilling fluid for discharge. Nozzles 36B and 36C for respective roller cutters 20B and 20C each have a large diameter orifice 40 and a small diameter orifice 42 provided therein for the discharge of high velocity drilling fluid. Large diameter orifice 40 has a stream 44 directed therefrom primarily against the gage row 28D and the adjacent row 28C. Small diameter orifice 42 has a stream 45 directed therefrom primarily against the cutting elements 26 in the remaining rows including row 28B. Thus, as a result of the large diameter orifices 40 directing a stream of drilling fluid radially outwardly of the stream of drilling fluid discharged from small diameter orifices 42, an increased flow of drilling fluid therefrom provides increased hydraulic action for the gage row of cutting elements.

Referring to nozzle 36A and particularly FIG. 4 thereof, which relates particularly to roller cutter 20A including the interlocking row 28C of cutting elements 36, a nozzle body is shown at 48 having a split ring 50 for mounting body 48. An orifice 52 in nozzle body 48 is elongated in a radial direction and increases progressively in cross-sectional area in a radially outwardly direction thereby to direct a stream of drilling fluid having increased energy at the radially outermost area of bit 10 at gage row 28D. In this manner, an increased amount of drilling fluid and increased hydraulic energy is provided progressively in a radial direction thereby to provide the gage row 28D of cutting elements 26 with increased hydraulic action.

As shown particularly in FIGS. 3 and 4, drilling fluid stream 54 from orifice 52 is shown striking bore hole bottom 30 on the leading side of and ahead of roller cutter 20A. A direction arrow 56 indicates the direction of movement of leg 16 in the bore hole as bit 10 is rotated. A rotation arrow 58 indicates the simultaneous rotation of cutter 20A with the movement of drill bit 10 in the bore hole. Thus, the high pressure drilling fluid stream 54 is directed toward the leading surface of the roller cutter body. Such a placement of stream 54 allows effective cleaning of inserts 26 as the inserts move through stream 54. After fluid stream 54 passes inserts 26, it strikes the bore hole bottom 30 generally at the juncture 35 of horizontal portion 32 and vertical side portion 34 as shown particularly in FIG. 4. Then, the drilling fluid along with cuttings that are chipped or gouged from the formation by inserts 26 move in an upward direction outside drill bit 10 through the bore hole in a conventional manner for return to the surface. Streams 44 and 45 of drilling fluid for roller cutters 20B and 20C are directed against the leading sides of roller cutters 20B and 20C in a manner similar to that of stream 54 against roller cutter 20A.

Thus, the formation and the cutting elements 26 impinged by stream 54 are subjected to separate or sequential cleaning actions immediately prior to their engagement thereby to provide relatively clean engagement surfaces. Such a separate or sequential cleaning action has been found to result in improved drill bit cutting action and increased rates of drilling penetration, particularly in drilling sticky formations.

It is to be understood that various sizes, shapes, and types of nozzles and orifices may be provided and located in various positions on the bit body to provide more hydraulic energy against the cutting elements in the gage row than the cutting elements in the remaining rows thereby to provide a more efficient use of hydraulic energy from the drilling fluid. For example, separate nozzles could be provided for orifices 40 and 42 if desired. As pointed out previously, the gage row and interlocking row of cutting elements are provided for cutting the bore hole formation at its strongest area generally at the juncture of the horizontal bottom portion with the vertical side portion. It is desirable that maximum cleaning action by the pressurized drilling fluid be provided particularly for the drilling elements in such gage and adjacent interlocking rows and the present invention is directed to a nozzle fluid system in which more hydraulic energy is directed against the cutting elements in the gage row and the adjacent row than in the remaining rows. As an example of such orifices for directing fluid streams in such manner, elongated orifices may be provided as illustrated by orifice 52 with the orifice being elongated in a radial direction and increasing in area in a radially outward direction. Therefore, a more efficient utilization of hydraulic energy is provided by the present invention as an increased amount of hydraulic energy is provided at the area of maximum need, i.e., in the area at or closely adjacent the juncture of the horizontal bottom portion with the vertical side wall portion of the bore hole where the formation is the strongest.

Referring now to FIGS. 5–8, a modified drill bit 110 is shown having a bit body 112 with legs 116 extending therefrom. Roller cutters 120A, 120B and 120C are mounted on legs 116 thereon for rotation Cutting elements 126 are arranged in concentric annular rows on roller cutters 120A, 120B and 120C with each cutter having a gage row 128D of cutting element 126 and an adjacent row 128C. Row 128C of roller cutter 120A provides an interlocking row of cutting elements.

Formed at the juncture of each pair of legs 116 is a recessed portion indicated generally at 127 which interrupts the generally smooth outer circumference of bit body 112. Each recessed portion 127 extends in a generally vertical direction along the juncture of each pair of adjacent legs 116 and provides an upward flow passage way for drilling fluid and entrained cuttings from bore hole bottom 130. Since the main upward flow stream of drilling fluid and cuttings will be directed through the generally vertical flow passages formed by recessed portions 127 of bit body 112, it is desirable that the discharge nozzles be positioned so that minimal overlapping interference occurs between the main downward and upward flow streams.

Figure 7:
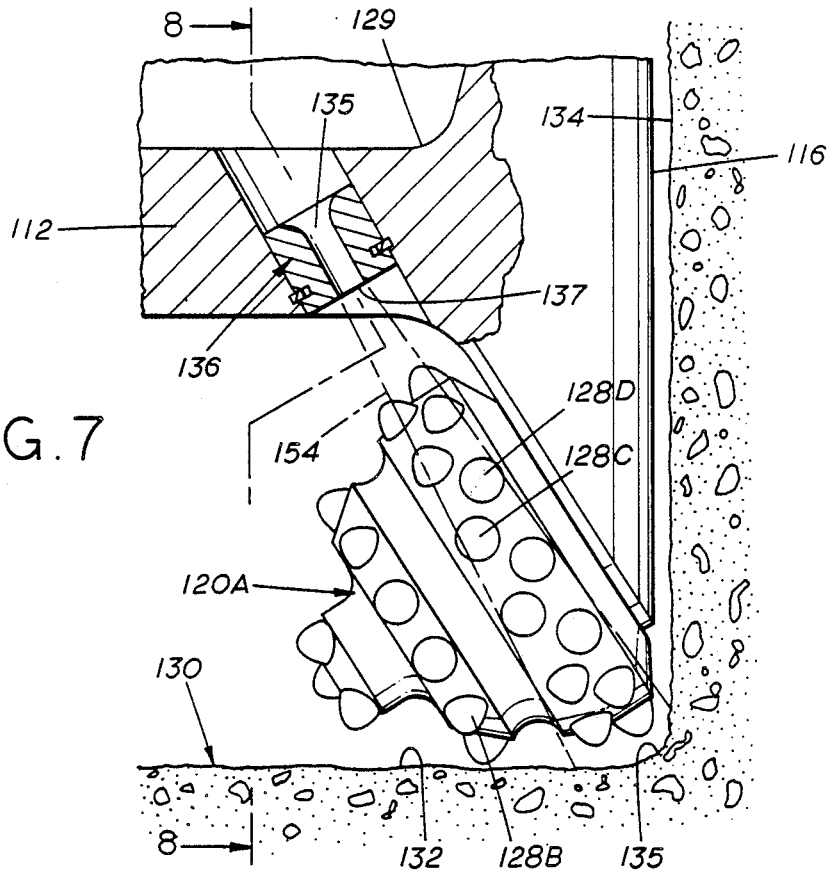
FIG. 7 is a generally schematic view of the stream of drilling fluid taken generally along line 7—7 of FIG. 6 and showing the drilling fluid directed against the gage row of cutting elements and the adjacent formation.
Figure 8:
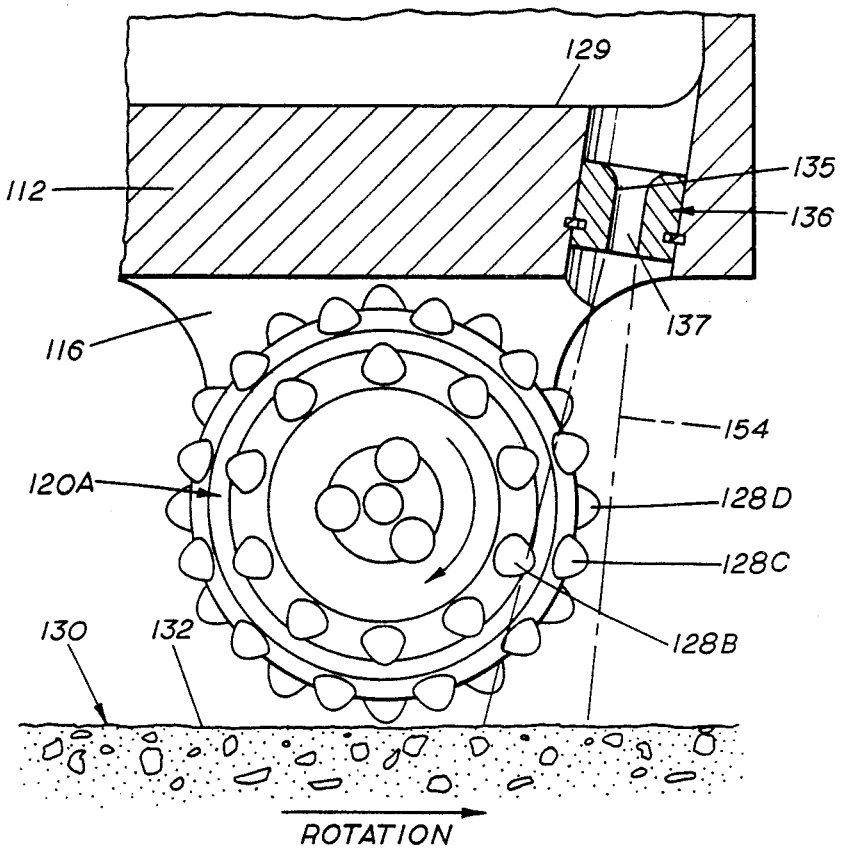
FIG. 8 is a generally schematic view taken generally along line 8—8 of FIG. 7 and showing the stream of drilling fluid against the gage and adjacent row of cutting elements.

A high velocity drilling flow chamber is shown at 129 receiving pressurized drilling fluid from a connected drill string. A nozzle 136 positioned inwardly of the outer circumference of bit body 112 is provided for each roller cutter 120A, 120B and 120C and has a flow passage 135 in fluid communication with chamber 129. Nozzle 136 has a single circular orifice 137 for directing a high velocity stream 154 of drilling fluid against the outer gage row 128D in a manner similar to the embodiment of FIGS. 1–4. Stream 154 engages the bore hole bottom 130 at the juncture 135 of horizontal bore hole portion 132 and vertical bore hole portion 134 as shown in FIG. 7.

Thus, the location of nozzle 136 and orifice 137 is such that high velocity drilling fluid is directed against the cutting elements of the gage row to provide more hydraulic energy against the cutting elements in the gage row than against the cutting elements in the remaining rows. The high velocity drilling fluid after cleaning the cutting elements of the gage row 128D then engages the bore hole bottom formation at or closely adjacent the juncture 135 of the horizontal portion 132 with the vertical side portion 134 where the formation is normally the strongest thereby to provide an efficient and economical utilization of drilling fluid. While only a single nozzle is shown for each roller cutter in the embodiment of FIGS. 5–8, it is to be understood that large diameter bits, such as, for example, bits around 18–24 inches in diameter, may have additional nozzles or orifices for each roller cutter However, in this event, the nozzles and orifices would be positioned and sized so that more hydraulic energy would be applied against the gage row of cutting elements than against the remaining rows of cutting elements.

While preferred embodiments of the present invention have been illustrated in detail, it is apparent that modification and adaptations of the preferred embodiments will occur to those skilled in the art. However, it is to be expressly understood that such modifications and adaptations are within the spirit and scope of the present invention as set forth in the following claims.

What is claimed is:

1. A rotary drill bit for drilling a well bore, said bit comprising:

a bit body having three cylindrical journals extending therefrom and three roller cutters mounted for relative rotation on said journals, each roller cutter comprising a generally conical roller cutter body and a plurality of cutting elements on the roller cutter body arranged in a plurality of spaced concentric annular rows including an outermost large diameter gage row of cutting elements;

a plurality of nozzle orifices on the bit body for discharge of liquid drilling fluid from the bit in a plurality of high velocity liquid streams, at least one roller cutter including an interlocking row closely adjacent the gage row thereof with the cutting elements in said interlocking row staggered relative to the cutting elements in said gage row and having a cutting path extending into the cutting path of said gage row, said one roller cutter having an associated orifice of a predetermined size positioned on the bit body at a location above the rotational axis of said one cutter at the connection of its associated journal to the bit body to direct a stream of drilling fluid against the cutting elements on the leading side of said one cutter, the orifice and associated liquid stream for said one roller cutter being angled and positioned relative to said one cutter for directing drilling fluid against cutting elements in at least the gage row;

said orifice and associated liquid stream for said one cutter further being formed and positioned for directing more hydraulic energy against the cutting elements on the gage row than the cutting elements on any other rows including the interlocking row and for impinging the bottom of the bore hole thereafter generally at the juncture of the horizontal bottom portion thereof with the vertical side portion.

2. A rotary drill bit for drilling a well bore, said bit comprising:

a bit body having three cylindrical journals extending therefrom and three roller cutters mounted for relative rotation on said journals, each roller cutter comprising a generally conical roller cutter body and a plurality of cutting elements of a similar shape and size on the roller cutter body arranged in a plurality of spaced concentric annular rows including an outermost large diameter gage row of cutting elements;

a plurality of nozzle orifices on the bit body for discharge of liquid drilling fluid from the bit in a plurality of high velocity liquid streams, at least one roller cutter having an associated orifice positioned on the bit body at a location above the rotational axis of said one cutter at the connection of its associated journal to the bit body to direct a stream of drilling fluid against the cutting elements on the leading side of said one cutter, the orifice and associated liquid stream for said one roller cutter being angled and positioned relative to said one cutter for directing drilling fluid against cutting elements in at least the gage row;

said orifice and associated liquid stream for said one cutter further being formed and positioned for directing more hydraulic energy against the cutting elements on the gage row than the cutting elements on any other rows and for impinging the bottom of the bore hole thereafter generally at the juncture of the horizontal bottom portion thereof with the vertical side portion;

said nozzle orifice for said one roller cutter being of a size and shape to provide an increased flow of drilling fluid at its radially outermost area thereby to provide increased hydraulic energy thereat for said gage row of cutting elements.

3. The rotary drill bit as set forth in claim 2 wherein said nozzle orifice for said one roller cutter has an increased cross-sectional dimension at its radially outermost area thereby to provide increased hydraulic energy to said gage row.

4. The rotary drill bit as set forth in claim 1 wherein the cutting elements in at least said gage row of said one roller cutter enter the stream of drilling fluid for being cleaned and then exit the stream prior to engaging the formation at the bottom of the bore hole so that the formation and cutting elements impinged by the stream are subjected to separate and sequential cleaning actions immediately prior to their engagement.

5. A rotary drill bit for drilling a well bore, said bit comprising:

a bit body having three cylindrical journals extending therefrom and three roller cutters mounted for relative rotation thereon on said journals, each roller cutter comprising a generally conical roller cutter body and a plurality of cutting elements on the roller cutter body arranged in a plurality of spaced concentric annular rows including an outermost large diameter gage row of cutting elements, the cutting elements on at least one roller cutter including an interlocking row closely adjacent the gage row thereof with the cutting elements in said interlocking row staggered relative to the cutting elements in said gage row and having a cutting path extending into the cutting path of said gage row;

a plurality of nozzle orifices positioned on the bit body at a location above the rotational axes of said cutters at the connections of said journals to said bit body for discharge of liquid drilling fluid from the bit in a plurality of high velocity liquid streams against the roller cutters, each roller cutter having an associated orifice to direct a stream of drilling fluid against the cutting elements on the leading side of the respective roller cutter, the orifice and stream discharged therefrom being angled and positioned relative to the associated cutter for directing drilling fluid against cutting elements in at least the gage row;

said orifices and associated liquid streams for said cutters further being formed of predetermined sizes and positioned for directing more hydraulic energy against the cutting elements on the gage rows than the cutting elements on any other rows including the interlocking row and for impinging the bottom of the bore hole thereafter generally at the juncture of the horizontal bottom portion thereof with the vertical side portion.

6. A rotary drill bit for drilling a well bore, said bit comprising:

a bit body having three cylindrical journals extending therefrom and three roller cutters mounted for relative rotation on said journals, each roller cutter comprising a generally conical roller cutter body and a plurality of cutting elements on the roller cutter body arranged in a plurality of spaced concentric annular rows including an outermost large diameter gage row of cutting elements; and a plurality of nozzle orifices positioned on the bit body at a location above the rotational axes of said cutters at the connections of said journals to said bit body for discharge of liquid drilling fluid from the bit in a plurality of high velocity liquid streams against the roller cutters, each roller cutter having an associated orifice to direct a stream of drilling fluid against the cutting elements on the leading side of the respective roller cutter, the orifice and stream discharged therefrom being angled and positioned relative to the associated cutter for directing drilling fluid against cutting elements in at least the gage row;

said orifices and associated liquid streams for said cutters further being formed and positioned for directing more hydraulic energy against the cutting elements on the gage rows than the cutting elements on any other rows and for impinging the bottom of the bore hole thereafter generally at the juncture of the horizontal bottom portion thereof with the vertical side portion;

said nozzle orifices being of sizes and shapes to provide an increased flow of drilling fluid at their radially outermost areas thereby to provide increased hydraulic energy thereat for said gage rows of cutting elements.

7. The rotary drill bit as set forth in claim 6 wherein each of said nozzle orifices has an increased cross-sectional dimension at its radially outermost area thereby to provide increased hydraulic energy to said gage row.

8. A rotary drill bit for drilling a well bore, said bit comprising:

a bit body having a threaded pin at its upper end adapted to be detachably secured to a drill string for rotating the bit and delivering liquid drilling fluid under pressure to the bit, a shank below said pin, and three legs extending below said shank at the lower end of the bit body, each leg having a downwardly and generally radially inwardly extending cylindrical journal thereon;

a roller cutter mounted for rotation on the journal of each leg, each roller cutter comprising a generally conical roller cutter body mounted on the respective leg for rotation about the longitudinal centerline of the journal and a plurality of cutting elements on the roller cutter body, each cutting element at least at a portion of its surface being formed of a material resistant to erosion by a high velocity stream of drilling fluid which may impinge it, the cutting elements of each roller cutter being arranged in spaced relation around the roller cutter body in a plurality of spaced concentric annular rows including an outermost large diameter gage row of cutting elements the cutting elements on at least one roller cutter including an interlocking row closely adjacent the gage row thereof with the cutting elements in said interlocking row staggered relative to the cutting elements in said gage row and having a cutting path extending into the cutting path of said gage row;

nozzle means having a plurality of nozzle orifices positioned on the bit body at a location above the rotational axes of said cutters at the junctures of said journals with said legs for discharge of liquid drilling fluid from the bit in a plurality of high velocity liquid streams including a liquid stream for each of the roller cutters, the liquid stream for each roller cutter being so angled and positioned relative to its associated cutter for directing drilling fluid against cutting elements in the gage row and the immediate adjacent row with the cutting elements in said rows entering the stream for being cleaned and then existing the stream prior to engaging the formation at the bottom of the bore hole so that the formation and cutting elements impinged by the steam are subjected to separate and sequential cleaning actions immediately prior to their engagement by the steam;

said nozzle orifices and associated liquid streams further being of predetermined sizes and shapes and positioned for directing more hydraulic energy against the cutting elements on the gage rows than any other rows including the interlocking row and for impinging the bottom of the bore hole generally at the juncture of the horizontal bottom portion thereof with the vertical side portion.

9. A rotary drill bit for drilling a well bore, said bit comprising:

a bit body having three cylindrical journals extending therefrom and three roller cutters mounted for relative rotation on said journals, each roller cutter comprising a generally conical roller cutter body and a plurality of cutting elements on the roller cutter body arranged in a plurality of spaced concentric annular rows including an outermost large diameter gage row of cutting elements;

a plurality of nozzle orifice means on the bit body for discharge of liquid drilling fluid from the bit in a plurality of high velocity liquid streams, at least one roller cutter having a gage row of cutting elements and an adjacent interlocking row of cutting elements, the cutting path of said interlocking row extending into the cutting path of said gage row with the cutting elements in said interlocking row staggered relative to the cutting elements in said gage row, said one roller cutter having an associated orifice means positioned on the bit body at a location above the rotational axis of said one cutter at the connection of its associated journal to the bit body to direct a stream of drilling fluid against the cutting elements on the leading side of said one cutter, the orifice means and associated liquid stream for said one roller cutter being angled and positioned relative to said one cutter for directing drilling fluid against cutting elements in at least the interlocking and gage rows;

said orifice means and associated liquid stream for said one cutter further being formed of a predetermined size and positioned for directing more hydraulic energy against the cutting elements on the gage row than against the cutting elements on any other rows including the interlocking row and for impinging the bottom of the bore hole thereafter generally at the juncture of the horizontal bottom portion thereof with the vertical side portion.

10. A rotary drill bit for drilling a well bore, said bit comprising:

a bit body having three cylindrical journals extending therefrom and three roller cutters mounted for relative rotation on said journals, each roller cutter comprising a generally conical roller cutter body and a plurality of cutting elements on the roller cutter body arranged in a plurality of spaced concentric annular rows including an outermost large diameter gage row of cutting elements;

a plurality of nozzle orifice means on the bit body for discharge of liquid drilling fluid from the bit in a plurality of high velocity liquid streams, at least one roller cutter having a gage row of cutting elements and an adjacent interlocking row of cutting elements which extend into the cutting path of said gage row, said one roller cutter having an associated orifice means positioned on the bit body at a location above the rotational axis of said one cutter at the connection of its associated journal to the bit body to direct a stream of drilling fluid against the cutting elements on the leading side of said one cuter, the orifice means and associated liquid stream for said one roller cutter being angled and positioned relative to said one cutter for directing drilling fluid against cutting elements in at least the interlocking and gage rows;

said orifice means and associated liquid stream for said one cutter further being formed and positioned for directing more hydraulic energy against the cutting elements on the gage row than against the cutting elements on any other rows including the interlocking row and for impinging the bottom of the bore hole thereafter generally at the juncture of the horizontal bottom portion thereof with the vertical side portion;

said nozzle orifice means for said one roller cutter being of a size and shape to provide an increased flow of drilling fluid at its radially outermost area thereby to provide increased hydraulic energy thereat for said gage row of cutting elements.

11. The rotary drill bit as set forth in claim 10 wherein said nozzle orifice means for said one roller cutter has an increased cross-sectional dimension at its radially outermost area thereby to provide increased hydraulic energy to said gage row.

12. The rotary drill bit as set forth in claim 9 wherein the cutting elements in at least said interlocking and gage rows of said one roller cutter enter the stream of drilling fluid for being cleaned and then exit the stream prior to engaging the formation at the bottom of the bore hole so that the formation and cutting elements impinged by the stream area are subjected to separate and sequential cleaning actions immediately prior to their engagement.

13. A rotary drill bit for drilling a well bore, said bit comprising:

a bit body having three cylindrical journals extending therefrom and three roller cutters mounted for relative rotation on said journals, each roller cutter comprising a generally conical roller cutter body and a plurality of cutting elements on the roller cutter arranged in a plurality of spaced concentric annular rows including an outermost large diameter gage row of cutting elements;

a plurality of nozzle orifices on the bit body for discharge of liquid drilling fluid from the bit in a plurality of high velocity liquid streams, at least one roller cutter having an associated orifice positioned on the bit body at a location above the rotational axis of said one cutter at the connection of its associated journal to the bit body to direct a stream of drilling fluid against the cutting elements on the leading side of said one cutter, the orifice and associated liquid stream for said one roller cutter being angled and positioned relative to said one cutter for directing fluid against cutting elements in at least the gage row;

said orifice and associated liquid stream for said one cutter further being formed and positioned for directing more hydraulic energy against the cutting elements on the gage row than the cutting elements on any other rows and for impinging the bottom of the bore hole thereafter generally at the juncture of the horizontal bottom portion thereof with the vertical side portion;

said plurality of nozzle orifices including a pair of radially spaced orifices for said one roller cutter with the radially outermost orifice thereof being of an increased size to provide increased hydraulic energy to said gage row of cutting elements.

14. A rotary drill bit for drilling a well bore, said bit comprising:

a bit body having a threaded pin at its upper end adapted to be detachably secured to a drill string for rotating the bit and delivering liquid drilling fluid under pressure to the bit, a shank below said pin, and three legs extending below said shank at the lower end of the bit body, each leg having a downwardly and generally radially inwardly extending cylindrical journal thereon;

a roller cutter mounted for rotation on the journal of each leg, each roller cutter comprising a generally conical roller cutter body mounted on the respective leg for rotation about the longitudinal centerline of the journal and a plurality of cutting elements on the roller cutter body, each cutting element at least at a portion of its surface being formed of a material resistant to erosion by a high velocity stream of drilling fluid which may impinge it, the cutting elements of each roller cutter being arranged in spaced relation around the roller cutter body in a plurality of spaced concentric annular rows including an outermost large diameter gage row of cutting elements; and nozzle means having a plurality of nozzle orifices positioned on the bit body at a location above the rotational axes of said cutters at the junctures of said journals with said legs for discharge of liquid drilling fluid from the bit in a plurality of high velocity liquid streams including a liquid stream for each of the roller cutters, the liquid stream for each roller cutter being so angled and positioned relative to its associated cutter for directing drilling fluid against cutting elements in the gage row and the immediate adjacent row with the cutting elements in said rows entering the stream for being cleaned and then exiting the stream prior to engaging the formation at the bottom of the bore hole so that the formation and cutting elements impinged by the stream are subjected to separate and sequential cleaning actions immediately prior to their engagement by the stream;

said nozzle orifices and associated liquid streams further being formed and positioned for directing more hydraulic energy against the cutting elements on the gage rows than any other rows and for impinging the bottom of the bore hole generally at the juncture of the horizontal bottom portion thereof with the vertical side portion;

said nozzle orifices being of sizes and shapes to provide an increased flow of drilling fluid to their radially outermost areas thereby to provide increased hydraulic energy for said gage rows of cutting elements.

* * * * *